United States Patent [19]

Judge

[11] Patent Number: 4,732,309

[45] **Date of Patent: * Mar. 22, 1988**

[54] STAPLE MAGAZINE

[75] Inventor: Alfred H. Judge, Raleigh, N.C.

[73] Assignee: Black & Decker, Inc., Towson, Md.

[ * ] Notice: The portion of the term of this patent subsequent to May 26, 2004 has been disclaimed.

[21] Appl. No.: 30,578

[22] Filed: Mar. 27, 1987

Related U.S. Application Data

[63] Continuation of Ser. No. 639,425, Aug. 10, 1984, Pat. No. 4,667,865.

[51] Int. Cl.[4] ..... B25G 5/16

[52] U.S. Cl. ..... 227/109; 227/125; 227/128

[58] Field of Search ..... 227/109, 120, 125, 128, 227/130, 131

[56] References Cited

U.S. PATENT DOCUMENTS

| | | | |
|---|---|---|---|
| 1,827,315 | 10/1931 | Hallen . | |
| 2,181,387 | 11/1939 | Weber | 227/120 |
| 2,643,376 | 6/1953 | Semler . | |
| 2,716,749 | 9/1955 | Timmerbeil | 227/109 |
| 2,934,039 | 4/1960 | Marano | 227/130 |
| 3,347,439 | 10/1967 | Doherty . | |
| 3,348,752 | 10/1967 | Wheble | 227/109 |
| 3,510,043 | 5/1970 | Larson . | |
| 3,958,738 | 5/1976 | Tremblay | 227/109 |
| 4,184,620 | 1/1980 | Ewig | 227/128 |
| 4,667,865 | 5/1987 | Judge | 227/109 |

FOREIGN PATENT DOCUMENTS

| | | | |
|---|---|---|---|
| 0069710 | 1/1983 | European Pat. Off. . | |
| 1905532 | 8/1964 | Fed. Rep. of Germany . | |
| 3126536 | 1/1983 | Fed. Rep. of Germany | 227/109 |
| 2490534 | 8/1980 | France . | |

*Primary Examiner*—Howard N. Goldberg
*Assistant Examiner*—Taylor J. Ross
*Attorney, Agent, or Firm*—Finnegan, Henderson, Farabow, Garrett & Dunner

[57] ABSTRACT

A magazine for a stapler capable of storing and feeding staples of different widths. A channel having parallel sides is divided by a central staple support into two parallel spaces. One of the spaces is wide enough to confine one leg of a U-shaped staple between one side and the central staple support. This, in cooperation with the central support, properly supports the staples irrespective of their width.

5 Claims, 4 Drawing Figures

STAPLE MAGAZINE

This is a continuation of application Ser. No. 639,425 filed Aug. 10, 1984, now U.S. Pat. No. 4,667,865.

BACKGROUND OF THE INVENTION

I. Field of the Invention

The present invention relates to a magazine for a stapler used to store and feed staples.

II. Background of the Invention

There are a number of staple configurations used in conventional staplers. The staples are generally U-shaped with the lengths of the legs of the U, as well as the distance between the two legs, different for different staples. Most staplers are capable of using only a single size staple with the possible exception of staplers that can accommodate staples of different lengths. However, most staplers cannot accommodate staples of different widths. An exception to that is disclosed in U.S. Pat. No. 3,958,738 which shows a staple magazine capable of accommodating both short and long staples, as well as narrow and wide staples. The device is relatively complex in that it includes a spring biasing means on both sides of the magazine to force the staple to a central position on a central support. While such a staple magazine may be capable of using staples of different sizes, it would not appear feasible that different sizes may be mixed within the stapler without the staples overlapping and jamming during the feeding operation. In addition, the complexity of the device makes it relatively expensive to manufacture.

It is the principal object of the present invention to provide a simple, economically manufactured staple magazine that will accommodate staples of differing widths and lengths.

It is an additional object of the present invention to provide a magazine capable of feeding and advancing staples of differing widths in the same magazine without jamming of the staples.

Additional objects and advantages of the invention will be apparent from the detailed description of the preferred embodiment or may be learned by practice of the invention.

SUMMARY OF THE INVENTION

The objects and advantages of the present invention are achieved by means of a magazine for a staple gun disposed to contain and feed U-shaped staples of various sizes. The magazine comprises a channel having parallel sidewalls. A U-shaped staple support member is disposed between the sidewalls of the channel and is parallel thereto. The support member is disposed to support staples vertically within the channel. One side of the support member is disposed parallel and adjacent to one side of the channel such that one leg of the staple is closely confined therebetween. The magazine further includes means for advancing the staples along the length of the magazine.

DESCRIPTION OF THE PREFERRED EMBODIMENT

The present invention will be disclosed in terms of a preferred embodiment which is a magazine for a stapler disposed to contain and feed U-shaped staples of various sizes.

Figure 4:
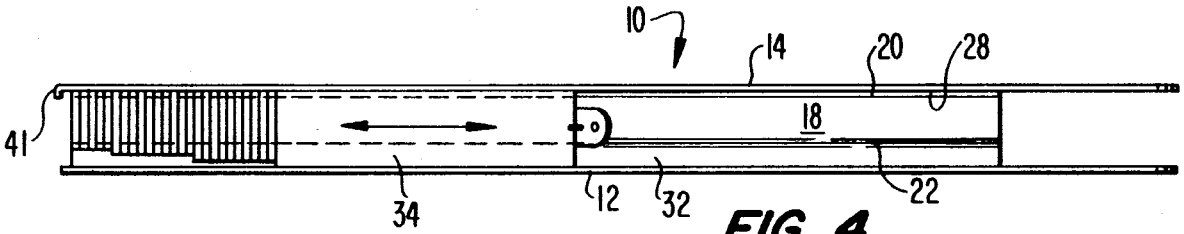
FIG. 4 is the top view of the embodiment of FIGS. 1 through 3 showing various size staples being advanced within the magazine.
Figure 2:
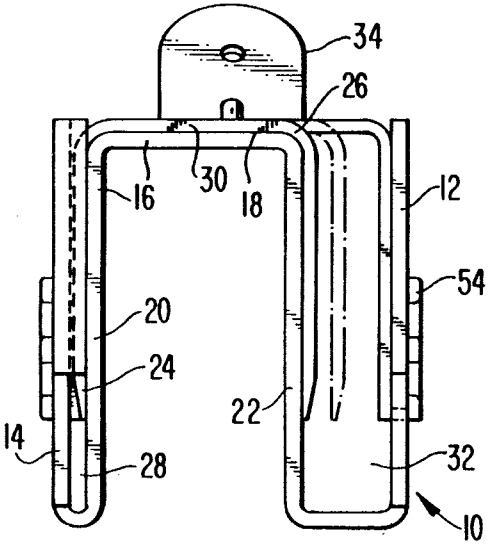
FIG. 2 is an end view of the embodiment of FIG. 1.

In referring to staples of various sizes, it is the vertical length of the legs and the horizontal distance between them that is being considered. Generally U-shaped staples may have varied leg lengths. And the widths between the two legs may vary as shown in FIG. 2. The thickness of the staples in the direction shown with the arrow in FIG. 4 may also vary, however, except for the gap at the exit end of the magazine and its interface with the staple driving mechanism, the magazine of the present invention is not directed to staples of any particular thickness. As shown in FIG. 4, the staples in the preferred embodiment have uniform thicknesses and the thickness of the staples is not known to be critical to the operation of the present invention.

Figure 3:
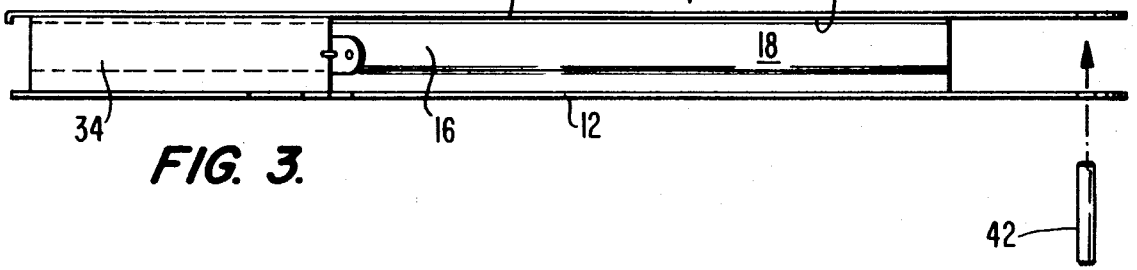
FIG. 3 is the top view of the embodiment of FIGS. 1 and 2.

In accordance with the invention, the magazine has a channel having parallel sidewalls. As here embodied, and most clearly depicted in FIG. 2, the channel 10 has two outer sidewalls 12 and 14. As shown in FIGS. 3 and 4, the outer sidewalls are generally parallel. The distance between the inner surfaces of sidewalls 12 and 14 will determine the maximum width of the staples being accommodated within the magazine. As shown in FIG. 2, the magazine is operable with staples that completely fill the width of the channel between the parallel sidewalls 12 and 14 as well as those staples that are somewhat narrower.

In accordance with the invention, the stapler includes a U-shaped staple support member disposed between the sidewalls of the channel and parallel thereto. As here embodied and most clearly depicted in FIGS. 2–4, the U-shaped support member 16 is disposed between the outer sidewalls 12 and 14 and extends along their length. The U-shaped support member has an upper support surface 18 and two sidewalls 20 and 22. As depicted in FIG. 2, it is the function of the upper surface 18 to support the U-shaped staple vertically within the channel.

In accordance with the invention, one side of the U-shaped support member is disposed to be parallel and adjacent to one side of the channel such that one leg of the staple is closely confined therebetween. As here embodied and most clearly depicted in FIG. 2, the left leg 24 of the staple 26 is confined between the outer sidewall 14 and the sidewall 20 of the U-shaped support member in the space shown in FIGS. 2, 3 and 4 as the staple confining space 28. The width of the staple confining space 28 should be less than two times the width of one leg of the staple as depicted in FIG. 2. By confining the left leg of the staple within the staple confining space and supporting the staple at its central portion 30, with the upper surface 18 of the central support 16, staples of different widths can be stored and fed through the magazine. As shown in FIGS. 2 and 4, the width between the legs of the staples is accommodated in the space 32 between outer sidewall 12 and sidewall 22. Because the left leg 24 of the staple is confined within the space 28 and the upper portion 30 of the staple rests on the surface 18, the staples are confined laterally and vertically within the magazine, even though the right leg of the staple is not closely confined within the space 32. Obviously, the magazine can be constructed with the staple confining space on either side of the channel without departing from the scope of the invention.

As here embodied, the magazine is constructed of a sheet metal staple guide which is bent to form the various elements of the magazine. As depicted in FIG. 2, the outer sidewalls, the inner sidewalls, and the U-shaped support member are all formed from one piece of sheet metal. The sheet metal is bent to form the two parallel upwardly directed channels 28 and 32 with the width of one of the channels disposed to closely confine one leg of the staple.

In accordance with the invention, the magazine includes means for advancing staples along the length of the magazine. As here embodied and depicted in FIG. 2, the staple advancing means is an elongated U-shaped staple advancing member 34 disposed to fit within channel 10. The staple advancing member has two projecting legs, one that projects within the staple confining space 28 and the other within the space 32. As shown in FIG. 2, the right leg of the staple advancing member abuts the inner surface of outer sidewall 12. In such an embodiment, the right side of the U-shaped staple advancing member does not need to engage the staples, however, the left side of the U-shaped member engages the leg of the staple within the space 28 and the adjoining portion of the staple advancing member which abuts surface 18 engages the portion 30 of the staple. In the present embodiment the U-shaped staple advancing member would contact a staple having the maximum width between the legs of the staple because one leg of the U-shaped staple advancing member is adjacent sidewall 12.

Figure 1:
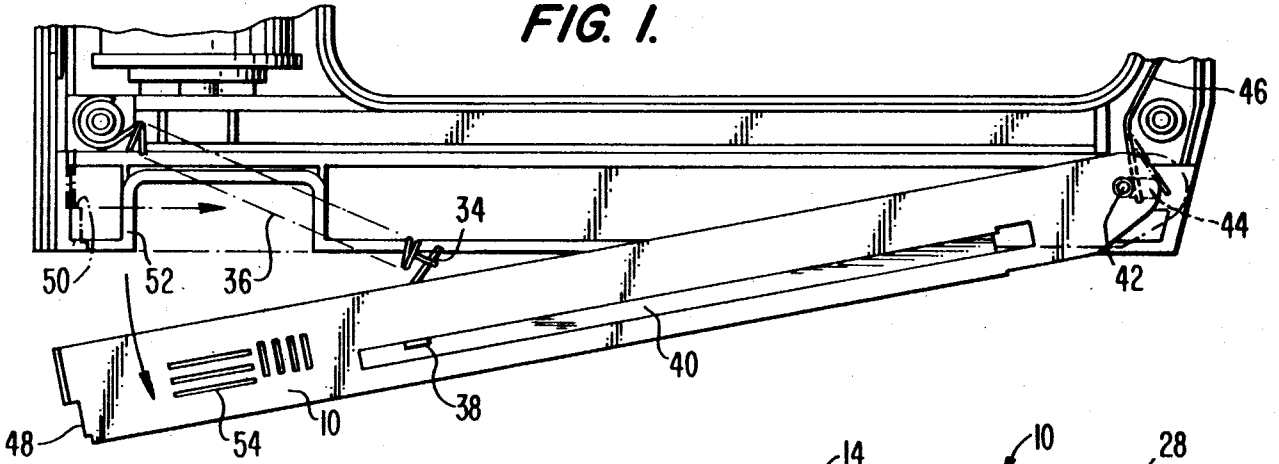
FIG. 1 is a partial side view of a stapler showing one embodiment of the present invention.

As depicted in FIG. 1, the U-shaped staple advancing member may include a spring 36 that biases the staple advancing member toward one end of the magazine, thereby advancing the staples within the magazine as they are removed. In the particular embodiment depicted, the staple advancing member is moved away from the staples when the magazine is rotated to facilitate loading. Upon rotation of the magazine back into the body of the stapler, the spring 36 moves the staple advancing member against the staples thereby urging them in the proper direction.

Preferably, the magazine includes a slot along the one sidewall of the staple guide with a projection from the staple advancing member disposed to engage the slot. As depicted in FIG. 1, the staple advancing member includes the projection 38, which is engaged into the slot 40 in the outer sidewall 12. Preferably, the projection is at the same end of the staple advancing member as the attachment to the spring means. This prevents the spring from cocking or rotating the staple advancing member within the magazine when it is opened to load the magazine. In addition, the projection abuts the end of slot 40 when the magazine is empty thereby preventing the staple advancing member from advancing to a portion where the staple driving member would hit it.

As depicted in FIG. 4, the magazine includes a tab 41 that is disposed to stop lateral movement of the staples within the magazine. FIG. 4 shows the configuration of this embodiment just after a staple has been driven from the magazine and before another staple has been advanced to the appropriate location.

As shown in FIG. 1, the embodiment is mounted within the stapler about a removable pin 42 at one extremity of the channel 10. The pin is disposed to ride within an elongated groove 44 in the body of the stapler and is biased toward the opposite end of the stapler by a leaf spring 46. The opposite end of the magazine includes notches 48 disposed to cooperatively engage with a notched surface 50 on the inner surface of the magazine housing to engage the magazine within the stapler. The magazine is moved to the right in FIG. 1, rotated upward into the body of the staper, and then allowed to move laterally left to engage the notches within the stapler body. The gap 52 in the stapler body facilitates grasping the sides of the magazine which, in other portions of the device, is covered by the sides of the stapler housing. Ribs 54 facilitate moving the magazine laterally against the spring 46 and vertically to engage the notches 50 and 48.

The present invention has been disclosed in terms of a preferred embodiment, however, the scope of the invention is not limited thereto, but is defined by the following claims and their equivalents.

What is claimed is:

1. In a stapler having a housing supporting means for selectively, downwardly ejecting U-shaped staples into a workpiece, the improvement comprising:

an elongated staple magazine for supporting and transversely confining independently of said housing a plurality of said staples, said magazine including a pair of transversely-spaced, parallel sidewalls defining the maximum transverse width of said staples and a pair of transversely-spaced, parallel inner walls disposed between and in fixed parallel relation to said sidewalls, said inner walls defining the minimum transverse width of said staples and slidably supporting said staples for longitudinal movement in said magazine, said side and inner walls defining two parallel, upwardly-open channels disposed to receive the legs of said staples, one said channel having a transverse width only slightly greater than the transverse width of said legs for closely confining one leg of each said staple and the other channel having a transverse width substantially greater than said one channel for receiving the other leg of each said staple thereby permitting said magazine to selectively contain staples of different transverse widths between said minimum and said maximum.

2. The stapler of claim 1 wherein said magazine is pivotally secured at one end thereof to said housing.

3. The stapler of claim 1 also including means for advancing said staples along the length of said magazine.

4. A stapler comprising:

a housing having first and second ends;

means in said housing for ejecting a staple from the first end thereof;

magazine means pivotally secured to the second end of said housing for containing and feeding towards the first end a plurality of U-shaped staples having different transverse widths, said magazine means comprising:

an elongated staple guide including parallel sidewalls and two parallel inner walls disposed between said sidewalls defining two parallel, U-shaped channels opened towards said housing, one said channel being disposed to receive and closely confine one leg of each said staple and the other channel being disposed to receive the other leg of each said staple, the transverse width of said other channel being substantially greater than the transverse width of said one channel, said inner walls being disposed to slidably support said staples and defining the minimum transverse width of said staples, the inner surfaces of said sidewalls defining the maximum transverse width of said staples, and means biased towards said first end for advancing all staples in said staple guide.

5. An elongated staple magazine for containing a plurality of U-shaped staples in position for selective downward ejection into a workpiece, said magazine comprising:

means defining the maximum transverse width of said staples for laterally restraining said staples;

means defining the minimum transverse width of said staples for supporting said staples for longitudinal movement in said magazine;

first elongated channel means fixedly defined between said restraining means and said supporting means for downwardly receiving and closely, laterally confining one leg of each said staple; and second elongated channel means laterally spaced from and parallel to said first channel means and fixedly defined between said restraining means and said supporting means for downwardly receiving the other leg of each said staple, the transverse width of said second channel means being substantially greater than the transverse width of said first channel means permitting said magazine to operatively accommodate staples having transverse widths between said minimum and said maximum.

* * * * *